US006357619B1

(12) United States Patent
Schaefer

(10) Patent No.: US 6,357,619 B1
(45) Date of Patent: Mar. 19, 2002

(54) DOMED CUP LIDS ESPECIALLY FOR USE WITH FROZEN CARBONATED BEVERAGES

(75) Inventor: Robert J. Schaefer, Baltimore, MD (US)

(73) Assignee: Sweetheart Cup Company, Inc., Owings Mills, MD (US)

( * ) Notice: Subject to any disclaimer, the term of this patent is extended or adjusted under 35 U.S.C. 154(b) by 0 days.

(21) Appl. No.: 09/618,803

(22) Filed: Jul. 18, 2000

(51) Int. Cl.[7] ..... A47G 19/22
(52) U.S. Cl. ..... 220/709; 220/713
(58) Field of Search ..... 220/213, 252, 220/780, 781, 782, 796, 361, 363, 703, 705, 709, 711–713, 716–717; D9/434, 454, 445

(56) References Cited

U.S. PATENT DOCUMENTS 3,048,317 A * 8/1962 Cochrane et al.
3,524,566 A * 8/1970 Parks
3,955,710 A * 5/1976 Commisso
4,408,690 A * 10/1983 Ferrero
4,471,880 A * 9/1984 Taylor et al.
D291,779 S * 9/1987 Inaba
D292,676 S * 11/1987 Mileto
D303,759 S * 10/1989 Mileos
5,253,781 A * 10/1993 Van Melle et al.
5,460,286 A * 10/1995 Rush et al.
D415,681 S * 10/1999 Yourist
D417,847 S * 12/1999 Rush et al.

* cited by examiner

*Primary Examiner*—Nathan J. Newhouse
(74) *Attorney, Agent, or Firm*—Nixon & Vanderhye P.C.

(57) ABSTRACT

Domed lids for beverage cups include an arcuately convex lower side wall section, and an arcuately convex upper side wall section protruding upwardly from the lower side wall section. Most preferably, each of these upper and lower side wall section is in the form of a respective spherical surface, with the upper side wall section having a lesser radius of curvature as compared to the radius of curvature of the lower side wall section. In particularly preferred forms, cup lids are provided having an arcuately convex lower side wall section establishing a circular base skirt adapted to being attached to an upper lip of a cup; and an arcuately convex upper side wall section. The upper side wall section is joined at a lower edge region thereof to the lower side wall section by means of an annular concavity, and protrudes coaxially upwardly from the lower side wall section to an annular apical edge region. The upper side wall section includes a reentrant well recessed below the apical edge region and defines an opening in a terminal surface thereof.

6 Claims, 3 Drawing Sheets

DOMED CUP LIDS ESPECIALLY FOR USE WITH FROZEN CARBONATED BEVERAGES

CROSS-REFERENCE TO RELATED APPLICATION

This application is related to commonly owned U.S. Design Patent Application Ser. No. 29/126,444 filed concurrently herewith entitled "Design For: DOMED CUP LID", the entire content of which is expressly incorporated hereinto by reference.

FIELD OF THE INVENTION

The present invention relates generally to lids for beverage drinking cups. In especially preferred forms, the invention is embodied in a domed cup lid which is especially useful for cups containing frozen carbonated beverages.

BACKGROUND AND SUMMARY OF THE INVENTION

Many popular beverages are dispensed with carbonation. The carbonation will thus tend to make the beverage foam somewhat creating a "head" which can spill over the sides of the cup in which it is dispensed and contained. This "head" can be particularly acute for frozen carbonated beverages—that is, beverages which contain flavored ice particles which are highly viscous, but nonetheless capable of being drawn through a straw. In particular, the head on frozen carbonated beverages is fairly cohesive and relatively self-supporting. As a result, a pleasing visual appearance of the beverage in the cup can be obtained since the beverage can literally be dispensed over the height of the cup lip thereby creating a mounded overfill.

Hemispherical lids are known which allow such a mounded overfill to be achieved, but yet prevent it from spilling over the sides of the cup, as shown in U.S. Pat. No. 4,508,235 (the entire content of which is expressly incorporated hereinto by reference). Specifically, the cup lid depicted in this prior-issued '235 patent is hemispherically shaped and defines a circular opening at the top of the lid to permit the dispenser tap to be inserted therethrough and thereby allow the beverage to be dispensed into the cup with the hemispherical lid in place.

Several problems can ensue, however, when such conventional cup lids are employed for frozen carbonated beverages. For example, the dispenser tap can form a seal against the edge of the lid opening which will cause a pressure force to build inside the cup lid and thereby potentially forcing the lid to separate from the cup. Furthermore, such conventional lids can promote overfilling of the cup since there is a tendency to dispense the beverage until it reaches the lid opening. As a result, little or no room is left to allow expansion of the frozen carbonated beverage resulting is spillage over the sides of the lid and cup.

More recently, a domed cup lid having an apical reentrant well and an angulated opening formed at the terminal surface of such reentrant well has been proposed in commonly owned U.S. patent application Ser. No. 09/410,070 filed on Oct. 1, 1999 (the entire content of which is incorporated hereinto expressly by reference). The angulated opening disclosed therein serves to define vent spaces between the edges of the opening and the dispenser tap to preclude pressure build-up when beverages, especially carbonated beverages, are dispensed. Moreover, the terminal surface of the recessed reentrant well portion in the lid of the '070 application provides a visual fill line to prevent overfilling of the beverage while also defining a convenient head space thereabove to allow for beverage expansion and thereby minimize (if not prevent entirely) spillage. The reentrant well also provides a reservoir to retain excess beverage which might be forced outwardly from the opening.

While the lid of the '070 application represents a significant advance in this art and an improvement over conventional domed lids, continual improvement is sought. It is towards providing such improvement that the present invention is directed.

Broadly, the present invention is embodied in a domed lid for a beverage cup comprised of an arcuately convex lower side wall section, and an arcuately convex upper side wall section protruding upwardly from the lower side wall section. Most preferably, each of these upper and lower side wall section is in the form of a respective spherical surface, with the upper side wall section having a lesser radius of curvature as compared to the radius of curvature of the lower side wall section.

In particularly preferred forms of the invention, cup lids are provided having an arcuately convex lower side wall section establishing a circular base skirt adapted to being attached to an upper lip of a cup; and an arcuately convex upper side wall section. The upper side wall section is joined at a lower edge region thereof to the lower side wall section by means of an annular concavity, and protrudes coaxially upwardly from the lower side wall section to an annular apical edge region. The upper side wall section includes a reentrant well recessed below the apical edge region and defines an opening in a terminal surface thereof.

These aspects and advantages of the present invention will be further understood by reference to the following detailed description of a preferred exemplary embodiment thereof.

BRIEF DESCRIPTION OF THE ACCOMPANYING DRAWINGS

A presently preferred exemplary embodiment of the present invention is illustrated in the accompanying drawings, wherein like reference numerals throughout the various Figures denote like structural elements, and wherein.

DETAILED DESCRIPTION OF THE INVENTION

Figure 1:
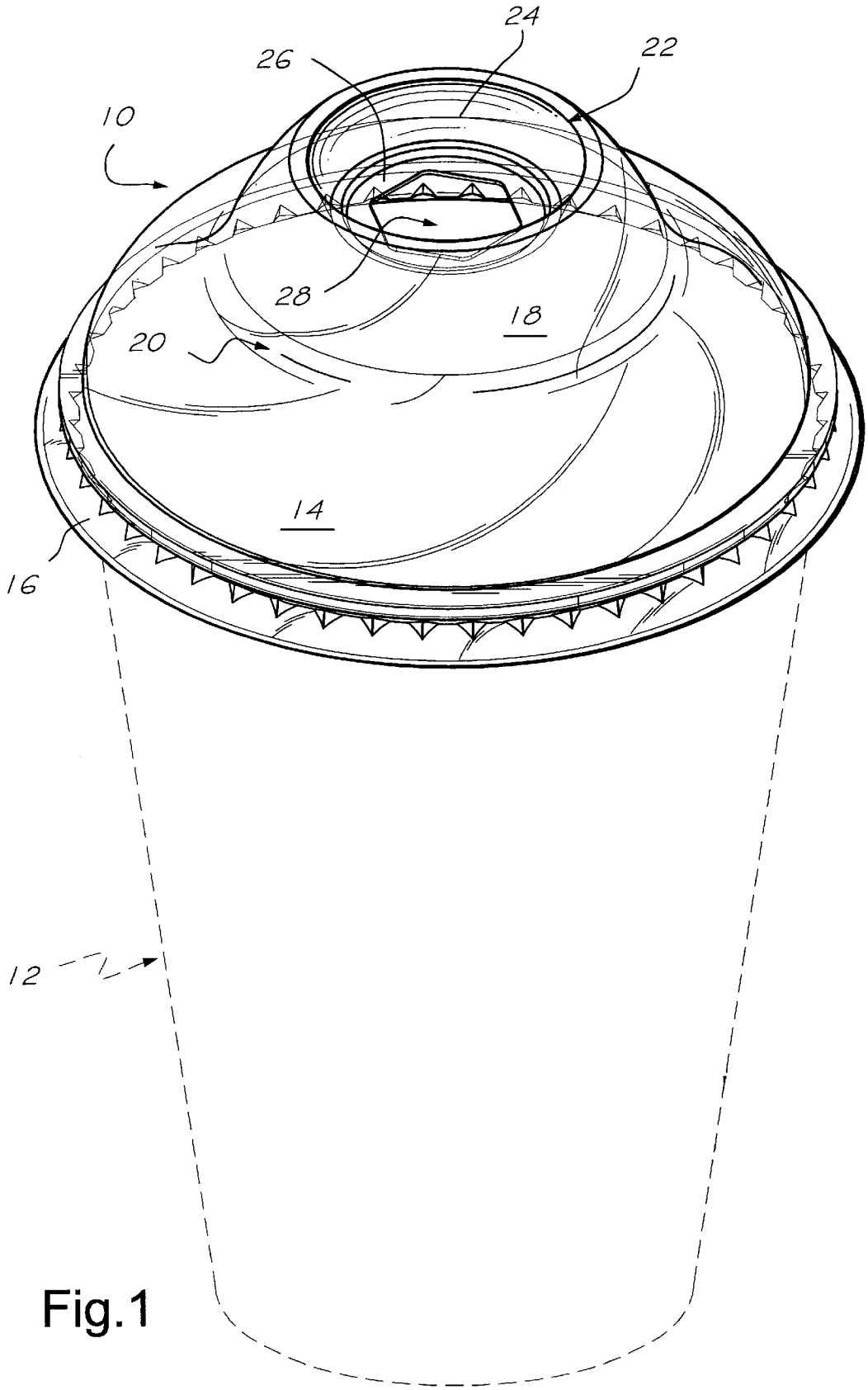
FIG. 1 is a perspective view of a domed lid for a beverage cup which embodies the present invention.
Figure 2:
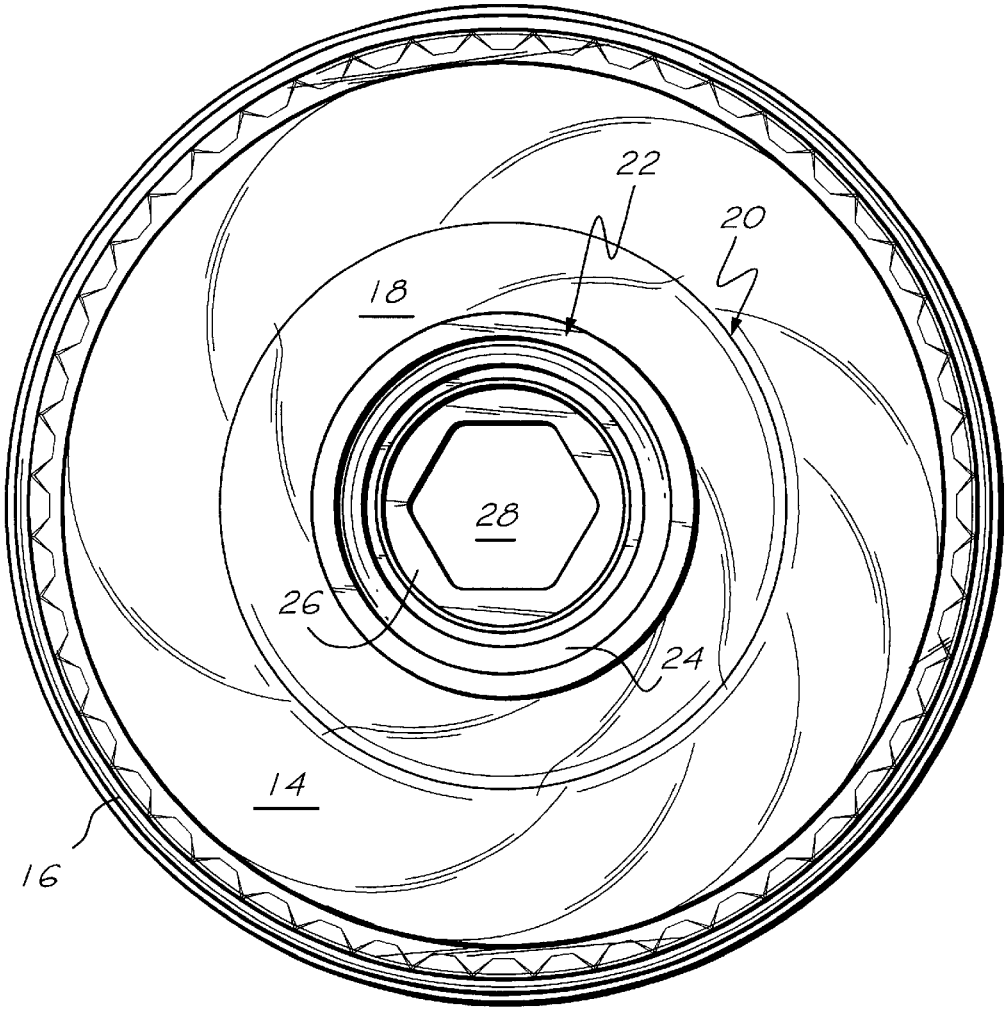
FIG. 2 is a top plan view thereof.

A particularly preferred embodiment of a domed lid 10 in accordance with the present invention is depicted in accompanying FIGS. 1–4 as being a one-piece (i.e., unitary) structure formed of a suitable food-grade plastics material. Most preferably, the domed lid 10 is formed of a transparent plastics material so that the contents dispensed into the cup 12 can be visually perceived therethrough. Translucent or opaque plastics materials can, however, be employed to form the lid 10, if desired.

As is seen, the lid 10 includes an arcuately convex lower side wall section 14 which has a circumferential skirt 16 sized and configured to be frictionally and/or mechanically engaged with the upper lip of the cup 12 so as to retain the lid 10 thereon. Most preferably, the lower side wall section 14, in the preferred embodiments, is in the form of segment of a spherical surface. The lower side wall section 14 is unitarily joined to an upper arcuately convex side wall section 18 by an annular concavity 20 parallel to the circumferential skirt but spaced upwardly therefrom. The annular concavity 20 provides a visual junction between the upper edge of the lower side wall 14 and the lower edge of the upper side wall 18.

Most preferably, the upper side wall section 18, like the lower side wall section 14, is in the form of segment of a spherical surface, but has a smaller radius of curvature as compared to the radius of curvature associated with the lower side wall section 14. The upper side wall section 18 is also most preferably coaxial with, and protrudes upwardly from, the lower side wall section 14 so as to establish an annular apical edge region 22.

Figure 3:
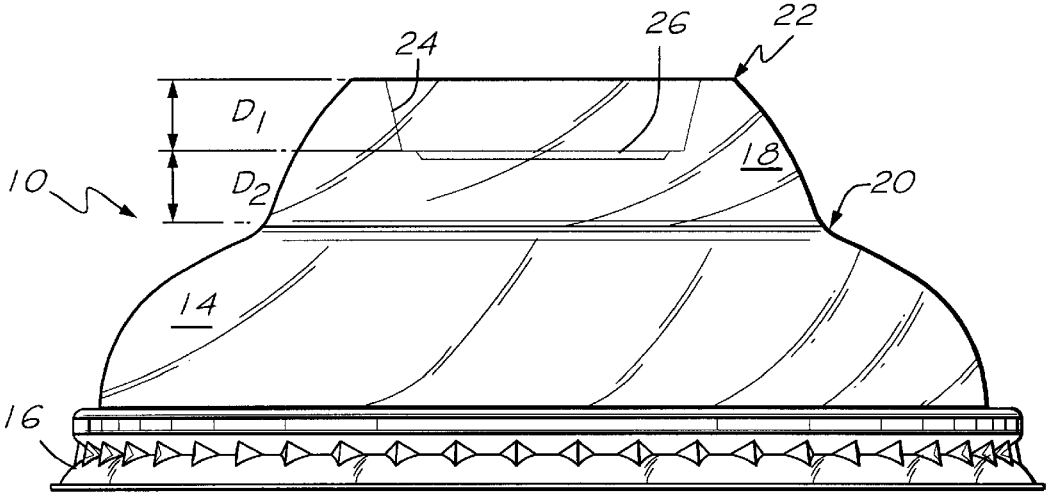
FIG. 3 is a side elevational view thereof.
Figure 4:
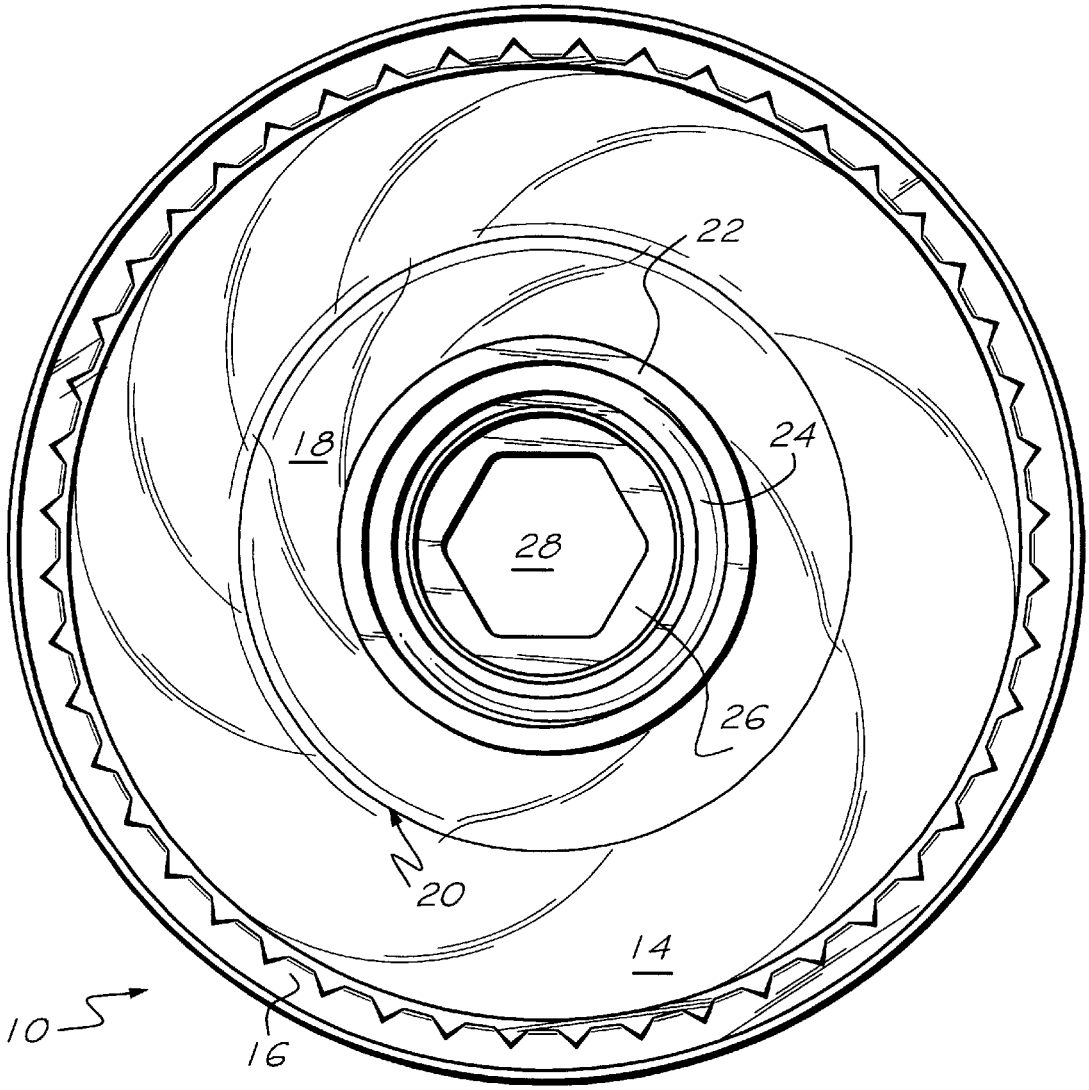
FIG. 4 is a bottom plan view thereof.

The apical edge region 22 is provided with a reentrant well 24 which, in the preferred embodiment, is in the form of a segment of an inverted right conical surface. The reentrant well terminates in a generally planar terminal surface 26 disposed parallel to the circumferential skirt 16 an annular concavity junction 22. As can be seen in FIG. 3, the terminal surface 26 of the reentrant well 24 is displaced downwardly from the apical edge region 22 by a dimension $D_1$, but is displaced upwardly from the annular concavity 20 by a dimension $D_2$. Since the reentrant well 24 is sloped downwardly, the annular edge region 22 has a larger diameter as compared to the diameter of the terminal surface 26.

The terminal surface 26 defines an angulated opening 28 to allow a beverage dispensing tap (not shown) to be inserted therethrough when a beverage is to be dispensed into a cup 12 on which the lid 10 is mated. By the term "angulated opening" is meant that the opening 28 is defined by a series of edges with adjacent intersecting ones of the edges forming an angle (preferably an obtuse angle) therebetween. Thus, in the embodiment depicted, the opening 28 is in the form of a general hexagon and formed by a series of six edges. Adjacent ones of the edges form an angle therebetween of about 120°. More or less edges than that depicted may be satisfactorily employed, however, to form opening 28, in which case the included angle defined between adjacent intersecting ones of the edges will vary by the equation $(n-2)/n \times 180°$, where n is the number of edges defining the opening 28.

As can now be understood, the domed lid 10 in accordance with the present invention is advantageous since the annular concavity 20 provides a convenient visible fill line for the operator to cease the beverage dispensing procedure. The internal volume of the lower convex side wall 14 serves as a primary "head space" (volume buffer) which allows expansion of the beverage thereinto above the plane of the cup lip. Moreover, the internal (but smaller) volume of the protruding upper side wall section 18 establishes a buffer to allow for some residual inherent beverage head expansion to occur following stoppage of the dispensing procedure. And, should the beverage expand into the annular volume surrounding the reentrant well 24, a portion of the beverage will be retained in the well without being spilled over the apical edge 22 and down the external sides of the cup lid 10, thereby preventing a potential messy situation.

Therefore, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A domed cup lid comprising:

an arcuately convex lower side wall section establishing a circular base skirt adapted to being attached to an upper lip of a cup; and an arcuately convex upper side wall section; wherein said upper side wall section is joined at a lower edge region thereof to said lower side wall section by means of an annular concavity, and protrudes coaxially upwardly from said lower side wall section to an annular apical edge region thereof, and wherein said upper side wall section includes a reentrant well recessed below said apical edge region thereof.

2. The domed lid of claim 1, wherein each of said upper and lower side wall section is a spherical surface.

3. The domed lid of claim 2, wherein said upper side wall section has a lesser radius of curvature as compared to said lower side wall section.

4. The domed lid of claim 1, wherein the reentrant well includes a terminal lower surface, said reentrant well being downwardly sloped from said apical edge towards said terminal lower surface.

5. The domed lid of claim 4, wherein said terminal lower surface defines an opening.

6. The domed lid of claim 5, wherein said opening is an angulated opening.

* * * * *